US006929052B2

(12) United States Patent
Fischer et al.

(10) Patent No.: US 6,929,052 B2
(45) **Date of Patent: *Aug. 16, 2005**

(54) METHOD AND APPARATUS FOR UPHILL CASTING WITH A SLIDE VALVE CLOSURE PLACED ON THE CASTING TABLE

(75) Inventors: Alexander Fischer, Swisstal (DE); Wolfgang Müller, Bamberg (DE)

(73) Assignee: Hydro Aluminium Deutschland GmbH, Cologne (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/312,938

(22) PCT Filed: Jul. 7, 2001

(86) PCT No.: PCT/EP01/07823

§ 371 (c)(1),
(2), (4) Date: May 29, 2003

(87) PCT Pub. No.: WO02/04143

PCT Pub. Date: Jan. 17, 2002

(65) Prior Publication Data

US 2004/0250978 A1 Dec. 16, 2004

(51) Int. Cl.[7] ..... B22D 18/04
(52) U.S. Cl. ..... 164/119; 164/306
(58) Field of Search ..... 164/119, 306, 164/307, 308, 309, 310, 311

(56) References Cited

U.S. PATENT DOCUMENTS

| | | | |
|---|---|---|---|
| 3,529,753 A | 9/1970 | Mack | |
| 3,627,018 A | 12/1971 | Costello et al. | |
| 3,905,419 A | 9/1975 | Tenner | |
| 3,980,125 A | 9/1976 | Portalier | |
| 5,524,700 A | 6/1996 | Gosch | |

FOREIGN PATENT DOCUMENTS

| | | | |
|---|---|---|---|
| DE | 26 46 187 | | 4/1978 |
| HU | 207675 B | | 5/1993 |
| JP | 61-3653 | * | 1/1986 |
| JP | 1-241352 | * | 9/1989 |
| WO | WO 02/04148 | * | 1/2002 |

* cited by examiner

*Primary Examiner*—Kuang Y. Lin
(74) *Attorney, Agent, or Firm*—Proskauer Rose LLP

(57) ABSTRACT

A method for uphill casting/low-pressure casting, especially of light metal alloys, with a casting furnace lying below a casting table, having a riser pipe and a mouth opening of the riser pipe and having a mould with an underlying pouring-in opening and having a slide valve closure, forming a flow-through channel which for casting takes on a substantially straight, longitudinal course, wherein for shut-off in the slide valve closure, two opening sections of the flow-through channel directly adjacent one to the other are displaced with respect to one another transversely to the longitudinal course of the flow-through channel directly after casting with still liquid melt in the pouring-in opening, so that an overlying opening section remains in open communication with the pouring-in opening free from undercut and an underlying opening section remains in open communication with the mouth opening of the riser pipe, wherein the opening sections are completely offset with respect to each other.

21 Claims, 1 Drawing Sheet

METHOD AND APPARATUS FOR UPHILL CASTING WITH A SLIDE VALVE CLOSURE PLACED ON THE CASTING TABLE

BACKGROUND OF THE INVENTION

The invention relates to a method and an apparatus for uphill casting/low-pressure casting, especially of light metal alloys, with a casting furnace lying below a casting table, having a riser pipe and a mouth opening of the riser pipe and having a mould with an underlying pouring-in opening and having a slide valve closure for the pouring-in opening, forming a flow-through channel which for casting takes on a substantially straight, longitudinal course.

Compared with gravity casting, uphill casting has the substantial advantage of a smooth controlled casting process. By this means the entrance of air bubbles and oxidation skin which is associated with any turbulence of the melt during casting is avoided. When using core packages as moulds, the separation and entrainment of moulding material in the gate and in the runner can be avoided which otherwise leads to a deterioration in the quality of the castings.

A disadvantage with uphill casting is that in general it is necessary to wait for the solidification process of up to 15 minutes duration before the mould just filled can be removed and the next mould can be brought over the casting furnace. In order to rectify this disadvantage, it has already been proposed that moulds should be closed directly after the low-pressure casting in the pouring-in opening and removed immediately from the riser pipe.

It is known from CH 415 972 that moulds for low-pressure casting can be provided with an underlying shut-off valve and a feeder head positioned thereover, below the mould cavity. The shut-off valve consists of a slider plate lying inside a pouring-in channel with a flow-through opening which is displaced transversely with respect to the pouring-in channel. The feeder head has a volume-displacing slider piston. Although the feeder head is heatable, after closure of the shut-off valve there may be some solidification of the melt in the flow-through opening of the slider plate, which requires separate removal of the plug there formed before the next casting process.

SUMMARY OF THE INVENTION

The object of the following invention is to further improve a method and an apparatus of said type.

The solution lies in a method for uphill casting/low-pressure casting in which for shut-off in the slide valve closure, two opening sections of the flow-through channel directly adjacent one to the other are displaced with respect to one another transversely to the longitudinal course of the flow-through channel directly after casting with still liquid melt in the pouring-in opening, so that an overlying opening section remains in open communication with the pouring-in opening free from undercut and an underlying opening section remains in open communication with the mouth opening of the riser pipe, wherein the opening sections are completely offset with respect to each other. A corresponding apparatus according to the invention is characterised in that the slide valve closure is placed on the casting table and comprises two mutually displaceable plates, each having a flow-through opening, wherein the plates can brought into overlap with their flow-through openings for casting and the plates are displaceable towards each other for shut-off so that the flow-through opening in the upper plate is in open communication with the pouring-in opening free from undercut and the flow-through opening in the lower plate is in open communication with the mouth opening of the riser pipe, while the sections of the flow-through opening are completely offset with respect to each other.

With the method according to the invention and the apparatus according to the invention, a method is provided especially suitable for small castings in which it is not necessary to separate the riser pipe from the slide valve closure during successive casting processes so that any air access to the melt level in the riser pipe can be largely excluded. This particularly applies if, after shut-off, the melt in the riser pipe is only lowered so far that at least the lower longitudinal section of the flow-through channel is emptied of melt, to avoid any sticking of melt to the upper slide plate. Here it can especially be provided that after shut-off, the melt in the riser pipe is only lowered to slightly below the mouth opening of the riser pipe and that during lowering of the melt, the riser pipe is acted upon by protective gas at the mouth opening.

In a preferred embodiment, the process sequence is distinguished by the fact that the mould itself as an entity is displaced together with the upper longitudinal section of the flow-through channel of the slider unit. In order to accelerate the process sequence, it is hereby provided that the melt should be actively cooled inside the pouring-in opening and if necessary, also inside the upper longitudinal section of the flow-through channel at the latest after shut-off, i.e., the displacement of the longitudinal sections of the flow-through channel towards to one another. In this case, a mould is then removed from the slide valve closure immediately after solidification of the melt in the upper longitudinal section of the flow-through channel and in the pouring-in opening of the mould. It is thus not necessary to wait for solidification of the entire casting. In order to avoid shrinkage caritation during the complete solidification, either a subsequent active pressure application from above or a rotation of the mould through 180° after lifting is to be proposed. The effortless removal of the mould results from the undercut-free configuration of the upper section of the flow-through channel in which an easily demouldable plug forms on the casting. This is achieved by the flow-through opening in the upper plate and if necessary, jointly with this the pouring-in opening of the mould, expanding continuously upwards, especially having an upwardly expanding conicity.

The apparatus according to the invention is especially constructed such that the plates are held in a cassette fixed to the casting table and the upper plate is held in a holder displaceable in the cassette, on which the mould can be placed. This holder can especially be inserted in a sliding carriage guided in the cassette on which it is supported in a spring fashion.

A suitable mould can have a lower cylindrical connecting piece which forms the pouring-in opening and which fits into a connecting-piece insert or a connecting-piece receptacle in the holder for the upper plate which is aligned towards the flow-through opening in the upper plate. Here especially the front face of the cylindrical connecting piece of the mould can be positioned flush onto the upper plate and if the mould's own weight is too low, can be braced against this to produce an effective seal. In order to accelerate the sequence of the casting processes as specified above, there are provided as cooling devices a coolant ring at the connecting-piece insert or the connecting-piece receptacle in the holder of the upper plate and a cooling chamber below or in the lower plate. The coolant feed pipe to the coolant ring must be elastic in this case in order to be able to equalize the movements of the sliding carriage or the holder. The actuating device for the sliding carriage can be arranged directly on the cassette. The mould can be designed as a permanent mould or consist entirely of mould material. The connection between the riser pipe and the slider unit can be such that the riser pipe passes through the casting table in an opening and abuts with a contact plate directly against the stationary lower slide plate. However, it is also possible that there is inserted securely in the casting table a sprue bushing which lines the opening in the casting table and is clamped against the lower slide plate in a sealing fashion and that the riser pipe abuts with a contact plate against the lower edge of this sprue bushing. It is preferably provided that the flow-through opening in the lower plate and, if necessary, jointly with this, the parts forming the flow-through channel adjacent thereto in the downward direction as far as the mouth of the riser pipe, jointly expand continuously downwards, especially having a downward-expanding conicity so that when the melt level in the riser pipe is allowed to drop, no melt residue is caught in the flow-through channel.

The riser pipe can be axially elastically and angularly moveably joined to the casting furnace via a metal bellows connection while the casting furnace is held such that it is moveable in height to allow docking of the riser pipe at the casting table and separation of the riser pipe from the casting table. With the same type of axial elastic and angular moveable connection between the casting furnace and the riser pipe by means of a metal bellows, the casting table can also be moveable in height in kinematic permutation in order to accomplish said docking and separation between the riser pipe and the casting table.

Insofar as uphill casting/low-pressure casting according to the invention is discussed heretofor, this initially relates to methods and apparatus wherein a controllable gas pressure is applied to the melt level in the sealed furnace, which makes the melt in the riser pipe rise or fall. Also included however are other methods and apparatus which can controllably convey the melt in the riser pipe, e.g. magnetic pumping arrangements at the lower end of the riser pipe in the casting furnace.

The uphill casting/low-pressure casting is hereinbefore related to a perpendicular gate of the moulds wherefrom are derived the corresponding designations upper plate/upper section of the flow-through opening, lower plate/lower section of the flow-through opening. The subject matter of the invention is not departed from, however, if moulds having horizontal gates are used, wherein the term "upper" is logically to be replaced by "mould-side" and the term "lower" is logically to be replaced by "riser pipe side" with a horizontally aligned flow-through direction but otherwise unchanged geometry and kinematics.

BRIEF DESCRIPTION OF THE DRAWINGS

Details of the apparatus according to the invention are described in the following with reference to the drawings, wherein.

DETAILED DESCRIPTION OF THE INVENTION

Figure 1:
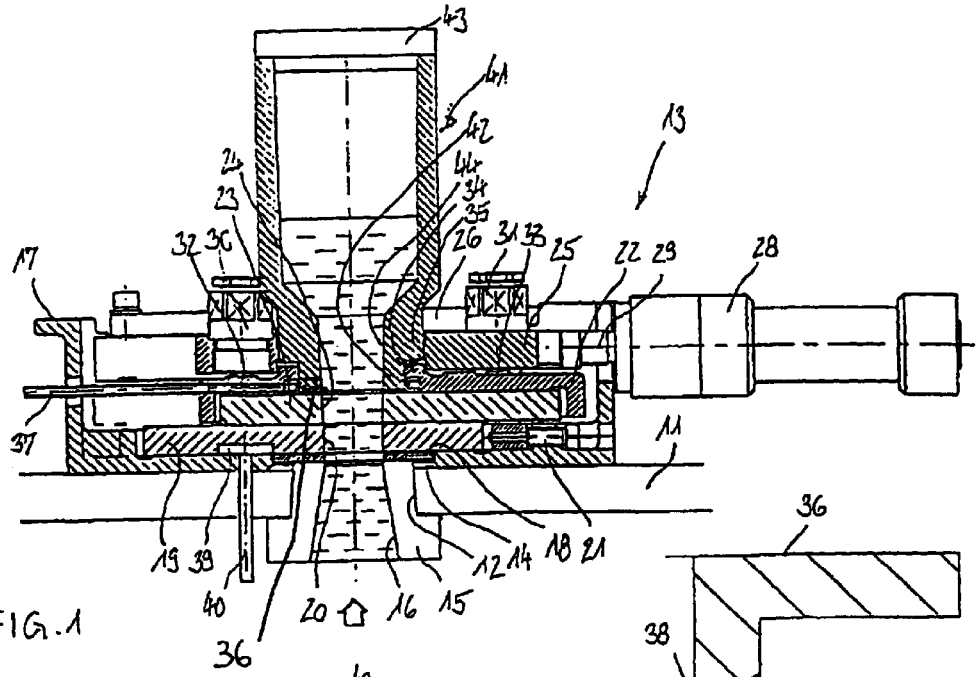
FIG. 1 shows an apparatus according to the invention in a first position during the casting process.

The two figures are first described jointly. A slider unit 13 is screwed onto a casting table 11 having a flow-through opening 12. In the flow-through opening 12 of the casting table 11 is inserted a sprue bushing 15 which at the same time forms a connection for the riser pipe of a casting furnace not shown. Inside the sprue bushing 15 there is provided an undercut-free opening 16 down to the riser pipe. The slider unit 13 comprises a cassette 17 which is screwed directly onto the casting table 11. For its part this cassette 17 has a lower opening 18 which is flush with said opening 16. In the opening 18 there is inserted a sealing ring 14 which abuts against the sprue bushing 15 in a sealing fashion. In the cassette 17 there is inserted a lower slide plate 19. The lower slide plate 19 is held via a thrust piece by a screw 21 screwed into the cassette 17. Inside the cassette 17 a holder 22 is held horizontally displaceably. In the holder there is inserted an upper slide plate 23 which has an upper flow-through opening 24 of the slider unit. The holder 22 is arranged at a sliding carriage 25 which is held by guide rails 26 in the cassette 17. Inserted in the sliding carriage 25 are compression spring domes 30, 31 whose pressure cylinders 32, 33 press the holder 22 downwards so that the slide plates 19, 23 abut onto each other with pre-stressing and fit in the cassette 17. Attached to the cassette 17 is an adjusting cylinder unit 28 which acts via a rod 29 on the sliding carriage 25 so that the holder 22 can be displaced horizontally in the cassette 17.

The lower slide plate 19 has a lower flow-through opening 20, the upper slide plate 23 has an upper flow-through opening 24. In coaxial assignment to the upper flow-through opening 24 the holder 22 has a connecting-piece projection 34 and the sliding carriage 25 has a connecting-piece receptacle 35. Also inserted in the connecting-piece projection 34 is a cooling ring 36 shown in enlarged detail, which can be supplied with cooling air via a compressed-air line 37. The cooling ring 36 has inwardly directed air outlet openings 38. In the lower slide plate 19 there is constructed a cooling chamber 39 which is supplied with cooling air via another compressed air line 40. Inserted in the connecting-piece projection 34 and the connecting-piece receptacle 35 is a mould 41 having a downward-pointing sprue connecting piece 42 which sits on the upper slide plate 23. The mould 41 is sealed by a lid 43. The sprue channel 44 of the mould 41 is flush with the upper flow-through opening 24 and jointly with this, is undercut-free in the upward direction, and especially is constructed as conically opening. The mould 41 can be a permanent mould or a sand mould or a core package.

FIG. 1 shows the position of the slider unit 13 for casting. The sliding carriage 25 with the holder 22 is pushed by means of the adjusting cylinder 28 into its right-hand position inside the cassette 17. In this case, the opening 16 in the sprue bushing 15, the flow-through opening 20 in the lower plate 19, the flow-through opening 24 in the upper plate 23 and the sprue channel 44 of the mould 41 are flush with one another. An arrow indicates how melt can be fed from a riser pipe to the opening 16 in the sprue bushing 15, to rise via the lower flow-through opening 20 and the upper flow-through opening 24 in the mould 41 until this is filled. Only at this point in time is it more logical to begin supplying cooling air to the cooling ring 36.

Figure 2:
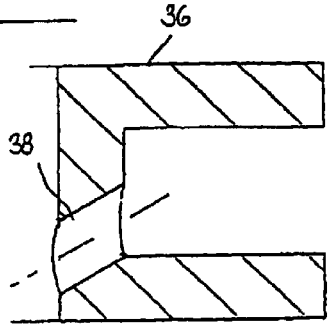
FIG. 2 shows the apparatus according to the invention as in FIG. 1 in a second position during the solidification process in the sprue.
Figure 2:
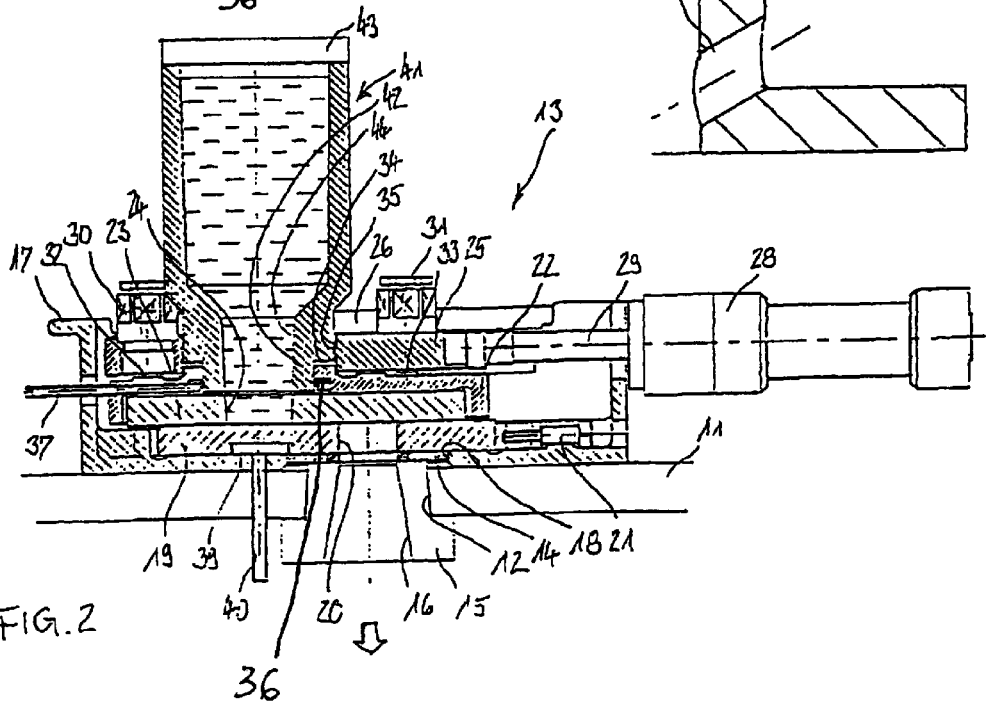

FIG. 2 shows how the sliding carriage 25 with the holder 21 is displaced by means of the adjusting cylinder 28 into the left-hand position inside the cassette 17 after completion of the casting process, wherein the upper flow-through opening 24 is sheared towards the lower flow-through opening 20 so that there is no longer any connection from the riser pipe to the mould. Only at this point in time is it more logical to supply cooling air to the cooling chamber 39 to make the melt in the now overlying sprue channel 44 solidify. After rapid solidification of the melt in the sprue channel 44, which can be accelerated by cooling the sprue connecting piece 42, the mould 41 can be lifted, wherein the plug in the upper flow-through opening 24 can easily be demoulded upwards on account of its upwardly conically opening undercut-free shape. From the opening 16 in the bushing 15 and the flow-through opening 20 in the lower plate 19, the melt is dropped back in the riser pipe as a result of pressure reduction in said pipe, as indicated by an arrow. In this case, the flow-through opening at least in the area of the sprue bushing 15, opens conically downwards with a totally undercut-free continuous course. After removal of the mould, a new mould is put in position and the apparatus is returned to the position as in FIG. 1 in which a further casting process can begin.

List of Reference Symbols

11 Casting table
12 Flow-through opening (11)
13 Slider unit
14 Seal
15 Sprue bushing
16 Opening (15)
17 Cassette
18 Opening (17)
19 Lower plate
20 Lower flow-through opening (19)
21 Screw
22 Holder
23 Upper plate
24 Upper flow-through opening (23)
25 Sliding carriage
26 Guide
27 Connecting-piece projection
28 Adjusting cylinder
29 Rod
30 Spring dome
31 Spring dome
32 Pressure cylinder
33 Pressure cylinder
34 Connecting-piece projection
35 Connecting-piece receptacle
36 Cooling ring
37 Compressed-air line
38 Air outlet opening
39 Cooling chamber
40 Compressed-air line
41 Mould
42 Sprue connecting piece
43 Lid
44 Sprue channel/pouring-in opening

What is claimed is:

1. A method for uphill/low pressure casting a liquid melt in a device which comprises a casting furnace lying below a casting table, the casting furnace having a riser pipe with a mouth opening, a mould having an underlying pouring-in hole, and a displaceable slide valve closure having a displaceable overlying opening section and a displaceable underlying opening section, said slide valve closure, when inserted between said casting furnace and said casting table, forming a flow-through channel comprising a substantially straight, longitudinal course during casting of the liquid melt, the flow-through channel being formed from the overlying opening section and the underlying opening section which are directly adjacent to one another, said method comprising:

casting the liquid melt in the pouring-in hole of the mould;

shutting off the slide valve closure;

displacing the overlying and underlying opening sections of the flow through channel with respect to one another and transversely to the longitudinal course of the flow-through channel directly after casting the liquid melt in the pouring-in hole of the mould, so that the overlying opening section remains in open communication with the pouring-in hole of the mould and the underlying opening section remains in open communication with the mouth opening of the riser, and the overlying and underlying sections are completely offset with respect to one another; and actively cooling the liquid melt located inside the overlying opening section of the flow-through channel beginning at the latest from the time the two opening sections of the flow-through channel are displaced with respect to one another.

2. The method of claim 1, further comprising lowering the liquid melt in the riser pipe after the slide valve closure is shut-off until at least the underlying opening section of the flow-through channel is emptied of liquid melt.

3. The method of claim 2, further comprising lowering the liquid melt in the riser pipe as far as slightly below the mouth opening of the riser pipe after the slide valve closure is shut off.

4. The method of claim 2, further comprising introducing a protective gas at the mouth opening of the riser pipe during the lowering of the liquid melt.

5. The method of claim 1, further comprising displacing the overlying opening section of the flow-through channel jointly with the pouring-in hole of the mould with respect to the underlying opening section of the flow-through channel, said underlying opening section being held in a fixed position at the mouth opening of the riser pipe.

6. The method of claim 5, further comprising displacing the mould together with the overlying opening section of the flow-through channel.

7. The method of claim 1, further comprising actively cooling the liquid melt inside the pouring-in hole of the mould at the latest from the time the two opening sections of the flow-through channel are displaced with respect to each other.

8. The method of claim 1, further comprising removing the mould from the slide valve closure immediately after solidification of the liquid melt in the overlying opening section of the flow-through channel and in the pouring-in hole of the mould.

9. The method of claim 1, wherein said liquid melt comprises light metal alloys.

10. An apparatus for uphill/low-pressure casting a liquid melt, said apparatus comprising:

a casting furnace lying below a casting table, the casting furnace having a riser pipe with a mouth opening;

a mould having an underlying pouring-in hole; and a displaceable slide valve closure constituting a flow-through channel comprising a substantially straight, longitudinal course during casting of the liquid melt, when said slide valve closure is slide valve closure is inserted between said casting furnace and said casting table, wherein the slide valve closure comprises two individually displaceable plates, an upper plate and a lower plate, each of said plates having a flow-through opening, wherein the two plates overlap with their flow-through openings during the casting of the liquid melt and are displaceable towards each other for shut-off directly after casting so that the flow-through opening in the upper plate is in open communication with the pouring-in hole free from undercut and the flow-through opening in the lower plate is in open communication with the mouth opening of the riser pipe while the flow-through openings are completely offset with respect to each other, and wherein a connecting-piece projection of a displaceable holder is surrounded by a coolant ring in the holder, said holder being connected to a coolant line.

11. The apparatus of claim 10, wherein the plates are held in a cassette secured to the casting table, and wherein the upper plate is held in the displaceable holder in the cassette on which the mould is placed.

12. The apparatus of claim 10, wherein the mould comprises a lower cylindrical sprue connecting piece, said sprue connecting piece forming the pouring-in hole which fits into a connecting-piece projection of the displaceable holder, said connecting piece projection being aligned towards the flow-through opening in the upper plate.

13. The apparatus of claim 12, wherein the front face of the cylindrical sprue connecting piece is placed on the upper plate.

14. The apparatus of claim 10, further comprising a coolant chamber below or inside the lower plate, said coolant chamber being connected to a coolant line.

15. The apparatus of claim 10, further comprising an actuating device for the holder, wherein said actuating device is arranged on the cassette.

16. The apparatus of claim 10, further comprising spring means acting on the holder, said spring means being supported in the cassette, and holding the upper plate and the lower plate braced against each other.

17. The apparatus of claim 10, wherein the riser pipe is suspended elastically flexibly in the casting furnace being adjustable in height with respect to the casting table.

18. The apparatus of claim 10, wherein the flow-through opening in the upper plate and the pouring-in hole continuously expand upwards, said flow-through opening and said pouring-in hole exhibiting an upwardly expanding conicity.

19. The apparatus of claim 10, wherein the flow-through opening in the lower plate and parts adjacent thereto in the downward direction as far as the mouth of the riser pipe, forming the flow-through channel, continuously expand downwards, exhibiting a downwardly expanding conicity.

20. The apparatus of claim 10, wherein the liquid melt further comprises light metal alloys.

21. The apparatus of claim 13, wherein the front face of the cylindrical sprue is braceable against the upper plate.

* * * * *